US006758424B2

(12) United States Patent
Lind et al.

(10) Patent No.: US 6,758,424 B2
(45) Date of Patent: Jul. 6, 2004

(54) LOW VOLTAGE ELECTROSTATIC CHARGING

(75) Inventors: Robert J. Lind, Robbinsdale, MN (US); Scott A. Olson, Chippewa Falls, WI (US); Charles E. Kasten, Princeton, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 0 days.

(21) Appl. No.: 10/380,711

(22) PCT Filed: Sep. 28, 2001

(86) PCT No.: PCT/US01/42383

§ 371 (c)(1),
(2), (4) Date: Mar. 14, 2003

(87) PCT Pub. No.: WO02/26390

PCT Pub. Date: Apr. 4, 2002

(65) Prior Publication Data

US 2003/0178513 A1 Sep. 25, 2003

Related U.S. Application Data

(60) Provisional application No. 60/237,006, filed on Sep. 29, 2000.

(51) Int. Cl.[7] ..... B05B 5/00

(52) U.S. Cl. ..... 239/690; 239/705; 239/706

(58) Field of Search ..... 239/290, 291, 239/690, 690.1, 705, 706

(56) References Cited

U.S. PATENT DOCUMENTS

| | | | | | |
|---|---|---|---|---|---|
| 3,591,080 | A | * | 7/1971 | Kock | 239/705 |
| 3,670,961 | A | * | 6/1972 | Tholome | 239/692 |
| 3,687,368 | A | * | 8/1972 | Geberth | 239/692 |
| 3,737,099 | A | * | 6/1973 | Shaffer | 239/707 |
| 4,106,697 | A | | 8/1978 | Sickles et al. | 239/15 |
| 4,186,886 | A | | 2/1980 | Sickles | 239/691 |
| 4,255,777 | A | * | 3/1981 | Kelly | 361/228 |
| 4,380,786 | A | * | 4/1983 | Kelly | 361/228 |
| 4,775,105 | A | * | 10/1988 | Rese | 239/704 |
| 5,044,564 | A | | 9/1991 | Sickles | 239/690 |
| 5,222,664 | A | * | 6/1993 | Noakes et al. | 239/3 |
| 5,409,162 | A | | 4/1995 | Sickles | 239/3 |
| 5,647,543 | A | | 7/1997 | Ma | 239/706 |
| 5,685,482 | A | * | 11/1997 | Sickles | 239/3 |
| 5,725,161 | A | * | 3/1998 | Hartle | 239/690 |
| 6,460,787 | B1 | * | 10/2002 | Hartle et al. | 239/691 |
| 6,622,948 | B1 | * | 9/2003 | Haas et al. | 239/706 |

FOREIGN PATENT DOCUMENTS

| | | | |
|---|---|---|---|
| GB | 2057300 A | * | 4/1981 |
| JP | 07178352 A | * | 7/1995 |

* cited by examiner

*Primary Examiner*—William E. Tapoloai
*Assistant Examiner*—Mohammad M. Ali
(74) *Attorney, Agent, or Firm*—Douglas B. Farrow

(57) ABSTRACT

An electrostatic method for increasing the transfer efficiency of spray finishing using lower voltages than are normally required and used with electrostatic spraying. The positioning and construction of ground electrodes (16) behind the air cap (18) helps ensure a clean operation.

3 Claims, 1 Drawing Sheet

LOW VOLTAGE ELECTROSTATIC CHARGING

TECHNICAL FIELD

This application is a continuation-in-part of U.S. application Ser. No. 60/237,006, filed Sep. 29, 2000.

BACKGROUND ART

Electrostatic spray guns are well known including those sold under the PRO GUN™ trademarks by Graco Inc. Such guns utilize a self-contained air turbine alternator combination in conjunction with a multiplier to produce voltages of 35 kV and up.

DISCLOSURE OF THE INVENTION

In the instant invention, a charging electrode is introduced in or near the point of atomization similar to a standard electrostatic spray gun. As described in U.S. Pat. No. 5,647,543, the contents of which are incorporated by reference, ground electrodes are placed close enough to the high voltage electrode to create a significantly high field strength and corona region at the end of the high voltage electrode when 10 to 20 kV of charge is applied.

It has been found that the optimum position for such ground electrodes is on the side of the gun body approximately 1.5 inches from the face of the air cap and utilizing a voltage of approximately 20 kV. When the ground electrode is placed at any position adjacent to the air cap (such as shown in the aforementioned patent), transfer efficiency and charging may be high but paint can build up quickly on the ground electrodes. This is due to the fact that the atomization process creates a number of stray particles just outside the normal spray envelope and these particles will be attracted to any ground close to the air cap when charging is active. By moving the ground electrodes back along the gun body a short distance, they are far enough away from the stray particles to maintain clean operation. If the ground electrodes are moved too far back, more voltage will be required to create the necessary field strength at the charging electrode.

Such a spray gun improves transfer efficiency over non-electrostatic spray guns and yet eliminates the build-up of paint which is common to other low voltage electrostatic configurations. Such a low voltage gun can be built smaller, lighter and at a lower cost than a conventional higher voltage gun. Compared to higher voltage spraying methods, the instant invention provides a charge to the atomized particles with far less stray ions which can cause other objects to charge up to unsafe levels. Lower field strength at the operator position means less voltage sensation and less paint wrap back onto the operator compared with conventional electrostatic guns, thereby achieving better operator comfort.

Under this configuration, the ground electrode's size and position is unobtrusive and will not interfere with the spraying operation. Construction is relatively simple because the ground path does not need to pass through the air cap or air cap ring.

These and other objects and advantages of the invention will appear more fully from the following description made in conjunction with the accompanying drawings wherein like reference characters refer to the same or similar parts throughout the several views.

BEST MODE FOR CARRYING OUT THE INVENTION

Figure 1:
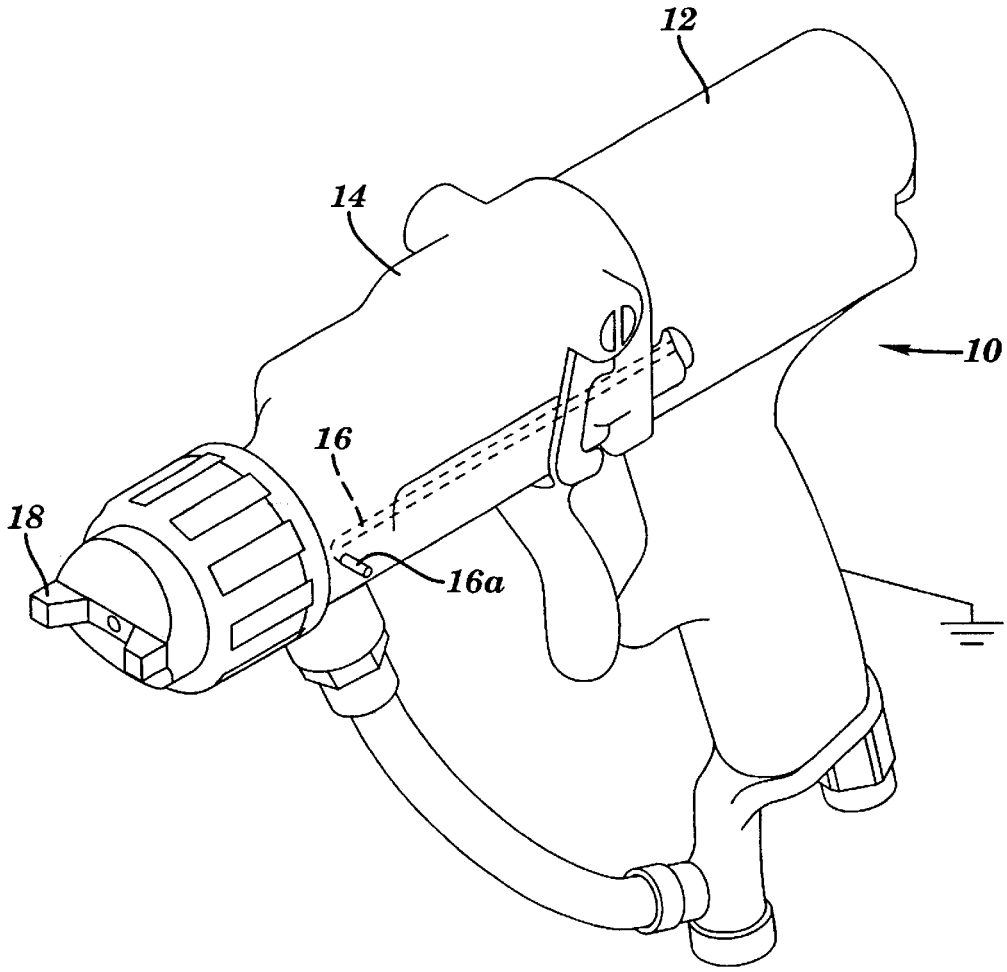
FIG. 1 shows a perspective view of the instant invention showing the ground electrodes extending from the side of the non-conductive gun barrel.

The instant invention generally designated as 10 as shown in FIG. 1 is comprised of a traditional conductive grounded gun handle 12 which has attached to the front thereof a non-conductive gun barrel 14. Ground electrodes 16 are molded into gun barrel 14 and have a tip 16*a* extending from either side. FIG. 1 only shows one such electrode 16 however a mirror image of such electrode exists on the other side of the gun. In the preferred embodiment, such electrode extends approximately 0.160 inches and has a diameter of 0.090 inches. The electrode passes through the barrel to contact the handle at the mounting point. As set forth previously, electrode tip 16*a* is approximately 1.5 inches rearwards of the point of atomization and the front of air cap 18.

It is contemplated that various changes and modifications may be made to the electrostatic spray gun without departing from the spirit and scope of the invention as defined by the following claims.

What is claimed is:

1. In an electrostatic spray gun having a conductive grounded gun handle and a non-conductive gun barrel attached thereto having an air cap and charging electrode at the end thereof, said air cap having a front end and a rear end, the improvement comprising at least one ground electrode extending outwardly from said gun barrel rearwardly of said air cap.

2. The electrostatic spray gun of claim 1 wherein said ground electrode is located about 1.5 inches rearward of said air cap front end.

3. The electrostatic spray gun of claim 1 comprising at least two ground electrodes, said ground electrodes being located on opposite sides of said barrel.

* * * * *